US007997322B2

(12) United States Patent
Knauer

(10) Patent No.: US 7,997,322 B2
(45) Date of Patent: Aug. 16, 2011

(54) COVERING DEVICE FOR SURFACES OR FOR WINDOWS, DOORS, OR SIMILAR OPENINGS

(76) Inventor: Dieter Knauer, Wendlingen (DE)

( * ) Notice: Subject to any disclaimer, the term of this patent is extended or adjusted under 35 U.S.C. 154(b) by 291 days.

(21) Appl. No.: 12/093,243

(22) PCT Filed: Nov. 14, 2006

(86) PCT No.: PCT/DE2006/001989

§ 371 (c)(1),
(2), (4) Date: May 9, 2008

(87) PCT Pub. No.: WO2007/059729

PCT Pub. Date: May 31, 2007

(65) Prior Publication Data

US 2008/0245487 A1 Oct. 9, 2008

(30) Foreign Application Priority Data

Nov. 21, 2005 (DE) ..... 10 2005 056 487

(51) Int. Cl.
*E06B 3/94* (2006.01)

(52) U.S. Cl. ..... 160/84.07; 160/134

(58) Field of Classification Search ..... 160/84.07, 160/134; 428/181; 416/73, 70 A; 493/413
See application file for complete search history.

(56) References Cited

U.S. PATENT DOCUMENTS

| | | | | |
|---|---|---|---|---|
| 1,533,396 | A | 4/1925 | Dabney | |
| 4,564,538 | A * | 1/1986 | Scholtz | 428/12 |
| 5,660,220 | A * | 8/1997 | Ruan | 160/84.07 |
| 6,561,257 | B2 * | 5/2003 | Huang | 160/370.23 |
| 2004/0182530 | A1 | 9/2004 | Huang | |
| 2006/0090858 | A1 * | 5/2006 | Heidenreich | 160/68 |

FOREIGN PATENT DOCUMENTS

| | | |
|---|---|---|
| DE | 93 17 918.9 | 2/1994 |
| JP | 2-35186 | 2/1990 |
| JP | 6-200680 | 7/1994 |
| JP | 2000-213255 | 8/2000 |
| JP | 2000-303758 | 10/2000 |
| JP | 2004-353188 | 12/2004 |
| JP | 2005-16055 | 1/2005 |
| WO | 90/09754 | 9/1990 |
| WO | 92/15764 | 9/1992 |
| WO | 2004/020773 | 3/2004 |

* cited by examiner

*Primary Examiner* — Blair M. Johnson

(74) *Attorney, Agent, or Firm* — Michael J. Striker

(57) ABSTRACT

A covering device for surfaces or for windows, doors, or similar openings or zones or for surface portions of the aforementioned items, has at least one covering element, which has movable element parts joined in zigzag fashion and capable of being fanned out and closed like a fan, which can be fanned out into an approximately two-dimensional shape of the covering element and closed to make a stack, and the at least one covering element has two peripheral parts, which either are independent or are formed by parts of the covering element and which in the fanned-out state extend at an angle to one another and which in a common zone are at least essentially brought together, and the element parts in the common zone are held together forming approximately a stacked block, and the stacked block is embodied as an independently freely movable part.

22 Claims, 6 Drawing Sheets

COVERING DEVICE FOR SURFACES OR FOR WINDOWS, DOORS, OR SIMILAR OPENINGS

CROSS-REFERENCE TO RELATED APPLICATION

The invention described and claimed hereinbelow is also described in German Patent Application DE 10 2005 056 487.9 filed on Nov. 21, 2005. This German Patent Application, whose subject matter is incorporated here by reference, provides the basis for a claim of priority of invention under 35 U.S.C. 119(a)-(d).

BACKGROUND OF THE INVENTION

The present invention relates to a covering device for surfaces or for windows, doors or similar openings.

A covering device of this kind is known (International Patent Disclosure WO 2004/020773 A2) in which the element parts are put together on one end in a common zone and are held together, forming approximately a stacked block. The peripheral parts of the covering elements fit over the stacked block and end with the free end of the stacked block that is diametrically opposite the other end of the element parts. The stacked block is secured at least to a peripheral part of the covering element, for instance by adhesive bonding, in such a way that the stacked block is to a certain extent a solid component of this peripheral part.

The known covering device has proved itself to a high degree. However, it has been found that because of the solid connection of the stacked block to at least one peripheral part, the capability of the covering element, in the fanned-out covering position, to cover the opening as completely as possible is not yet fully utilized.

SUMMARY OF THE INVENTION

The object of the invention is to design a covering device of the type defined at the outset in such a way that it is as simple, economical and light in weight as possible, on the one hand, and on the other enables the most complete possible covering of an opening, even in the zones in which, in the fanned-out covering position, the peripheral parts of the covering element extend.

Because the stacked block is embodied as an independently movable part, when the covering element is fanned out into the covering position, the stacked block is not a hindrance to its becoming completely fanned out. On being fanned out, the covering element can also unfold freely even in the common zone where the stacked block is located. As a result, when an opening is being covered by the covering element, in its fanned-out covering position, it is attained that both peripheral parts are brought close to associated opening edges in a parallel orientation to them, so that the opening zones located in the course of the peripheral parts are covered completely, and this is true also for the zone in which the stacked block extends. The invention is based in this respect on the recognition that free movability of the stacked block with respect to the peripheral parts, particularly on being fanned out into the covering position, is advantageous for unhindered fanning out into the covering position, even in the common zone.

In accordance with an independent subject of the invention the spatial contour of the stacked block is determined. In general, the stacked block may for instance have a rectangular or trapezoidal shape or suitably differently designed three-dimensional shapes. Advantageous further characteristics and embodiments of the invention reside in designs based on the recognition that by designing the individual lines and edges of the stacked block differently, the fanned-out covering element can be varied, for instance in such a way that stabilizing the covering element within the covering plane is attached by simple means with increased security, for instance against possibly falling out of the covering plane in one direction or the other extending transversely to the area of the covering plane. At the same time, it is guaranteed that for instance in the case of a covering device mounted on a window frame, an approximately horizontal gap will not be creased between the inner edge, which for instance is curved, of the window frame and the correspondingly curved free peripheral edge of the covering element.

Advantageous further characteristics and refinements of the invention reside in a kind of covering device, in which manifold further functions and properties can be integrated into the covering device without requiring major effort or expense. For instance, if the covering element is put in the fanned-out covering position to provide shading against sunshine, it is easily possible, if at least one function unit is embodied as a solar cell, to generate current in this way as well. If at least one function unit is embodied as a heating element, it can take on the function of an auxiliary heater, for instance, in such a way that with the covering element in the fanned-out covering position, by switching on the heating element the zone for instance of a window of a vehicle close to the heating element is heated and thus the window can be defrosted. If at least one function unit is embodied as an light-emitting medium, the possibility is opened up for instance of providing lighting, by means of a covering element in the fanned-out covering position or by means of a plurality of such covering elements in such a position. For instance, if individual windows of a vehicle are provided with a covering device whose covering element is in the fanned-out covering position, then a vehicle thus equipped can be made to light up, if one of the function units embodied as a light-emitting medium is switched on. This makes it recognizable faster in its surroundings. The security against theft can also be increased by a vehicle lighted up in this way. It is understood that switching on this kind of function unit embodied as an light-emitting medium can be done for instance by remote control or automatically by means of a dimmer switch or the like that is dependent on the ambient light. Moreover, the light-emitting medium mounted for instance on the outside of the covering element can also be controlled by means of a switch that is activatable as a function of distance, such as a proximity switch. If a parked vehicle is equipped in this way, then it lights up only if persons, vehicles, or the like come relatively close to it. Thus the vehicle is intentionally lighted, with a time limit for instance by means of a timer, and with partial, spatially narrowly defined lighting of the direct surroundings. Moreover, it can be advantageous for the light-emitting medium to be mounted in addition or only on the inside of the covering element and thus to furnish lighting inside the passenger compartment. It can also be advantageous for the light-emitting medium to be embodied as a design element with manifold lighting effects. Manifold further design possibilities of such function units are within the scope of the invention.

Further details and advantages of the invention will become apparent from the ensuing description.

The full wording of the claims has not been repeated above solely to avoid unnecessary repetition; instead, reference is merely made to it by referring to the claims, but all of these claims characteristics are considered to be expressly disclosed herein, in a manner essential to the invention. All the characteristics mentioned in the above description and the description that follows as well as all the characteristics that may be learned from the drawings are further components of the invention, even if they are not especially emphasized and in particular are not mentioned in the claims.

The invention is described in further detail in terms of exemplary embodiments shown in the drawings.

DESCRIPTION OF THE PREFERRED EMBODIMENTS

Figure 1:
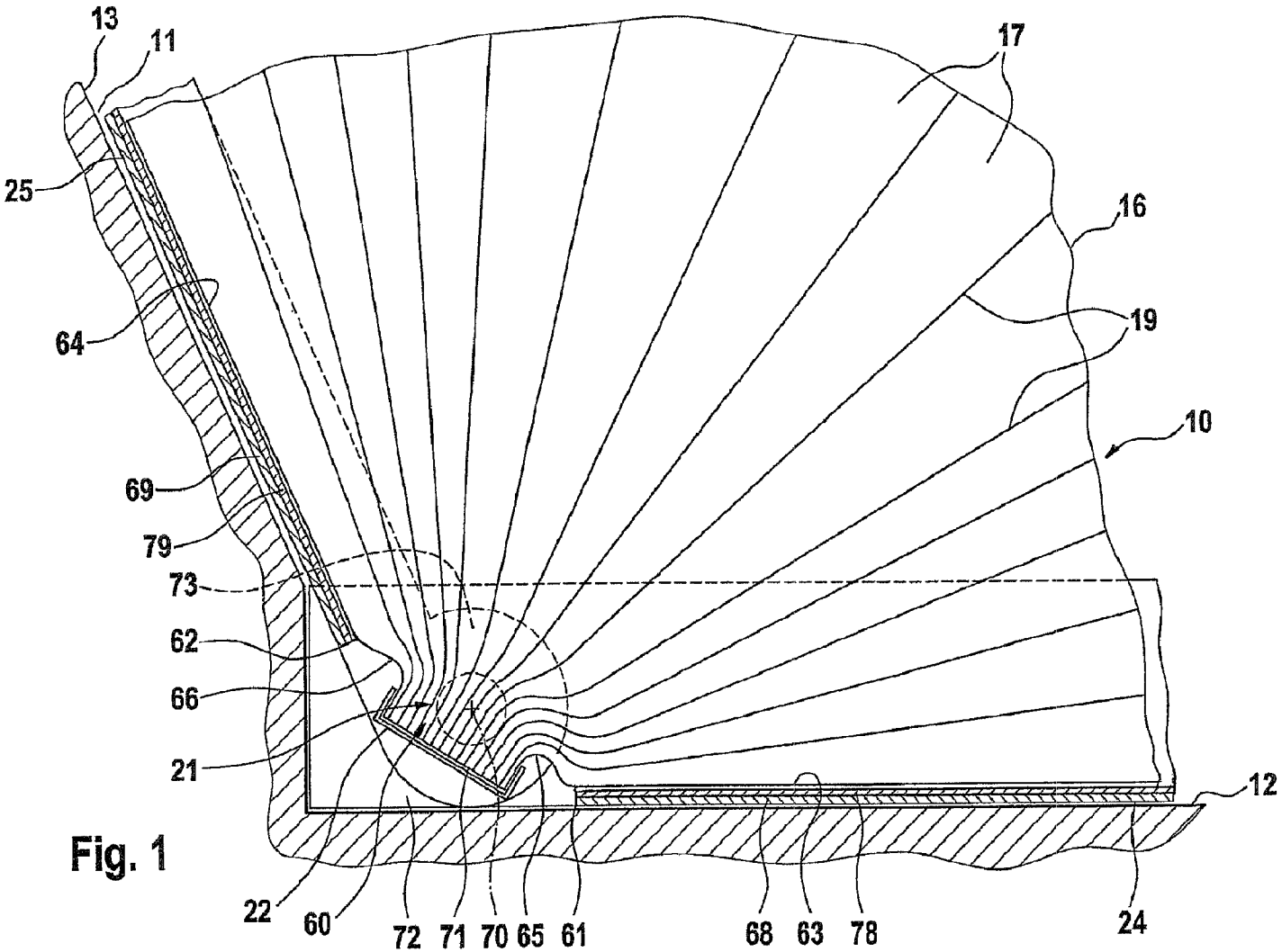
FIG. 1, a schematic side view of a covering device in a first exemplary embodiment, in a covering position in which an opening is completely covered.
Figure 2:
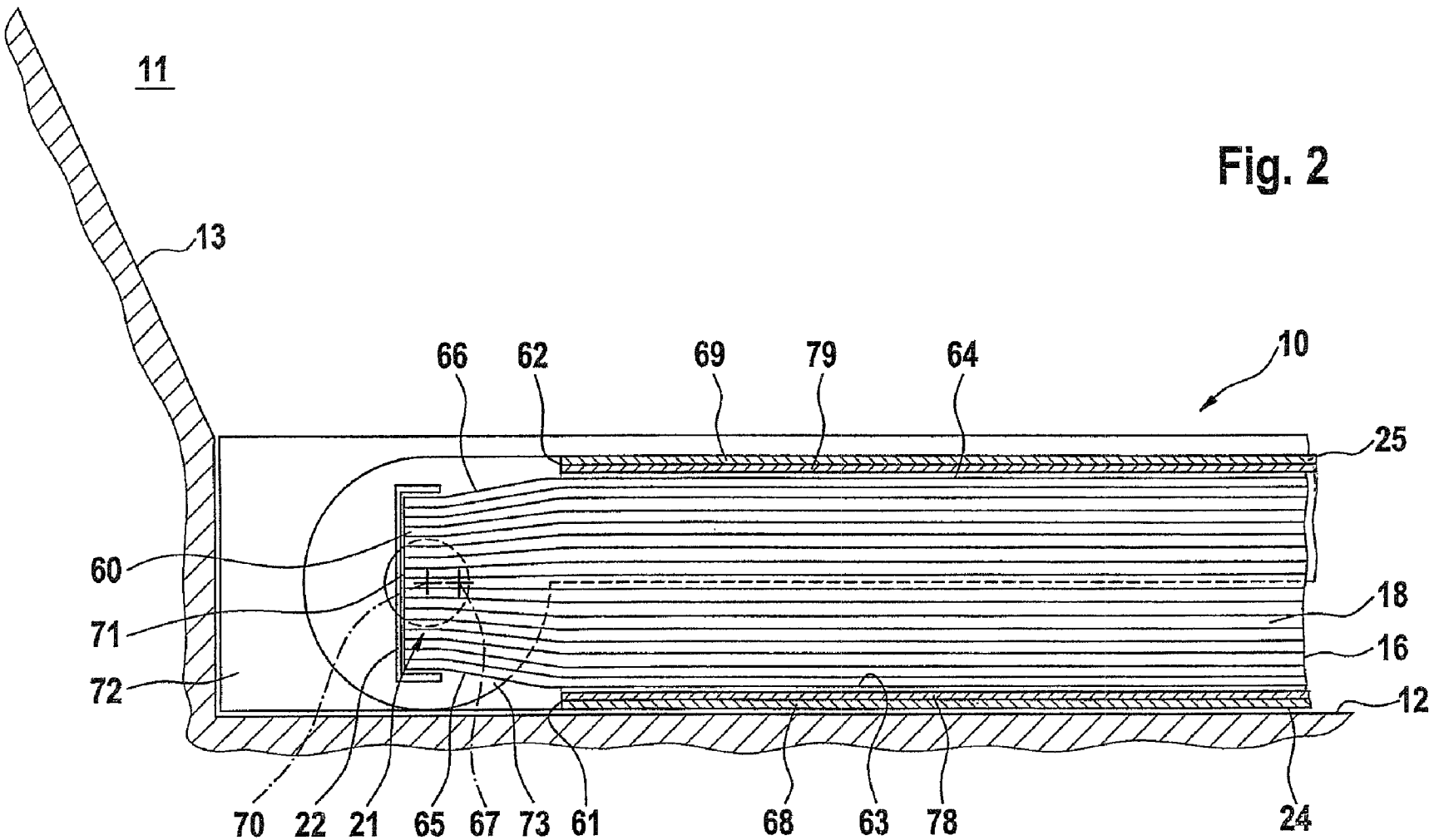
FIG. 2, a schematic side view, partly in section, of the covering device in FIG. 1, but in which the covering device is folded completely closed to form a stack.

In FIGS. 1 and 2, a covering device 10 in a first exemplary embodiment is shown, which is suitable very generally for surfaces or for windows, doors, or similar openings 11 or for zones or for surface portions of the aforementioned items. The covering device 10 may also serve as a partition element or shading element both indoors and outdoors, for instance as an awning-like sunscreen or as a visor, or for instance as a sun shade, of the kind needed in the area of the front window in vehicles and/or in the zone of the side windows, roof surfaces and rear windows. The fields in which such covering devices 10 can be used are extraordinarily many, and only some of them are noted above.

In the first exemplary embodiment shown in FIGS. 1 and 2, the covering device 10 is shown in conjunction with an opening 11 for which the covering device 10 can serve as a closure device. FIG. 1 shows that the covering device 10, in the fully fanned-out covering position, completely covers the opening 11, and in the nonoperative opening position shown in FIG. 2, it completely opens this opening 11. This opening 11 is an arbitrary opening, such as a window or door opening, and for instance such an opening in a building or vehicle, for instance a vehicle window, which may be a front or rear or side window of the vehicle. The opening 11 may for instance be that of a side window of a vehicle, in particular a motor vehicle, which can be closed for instance by means of a window that can be moved essentially vertically up and down. The opening 11 is bounded by a lower edge 12 and on the left by a lateral edge 13, as well as by one or more edges, not shown; some or all of these edges may be formed by a frame part, not further shown here.

The covering device 10 has at least one covering element 16, which has movable element parts 17 joined in zigzag fashion that can be fanned out and folded closed again and that can be fanned out into an approximately two-dimensional shape of the covering element 16 in such a way that the covering position shown in FIG. 1 results. In this fanned-out covering position, the covering element 11 with the fanned-out element parts 17 forms an approximately two-dimensional closure of the opening 11, which is thus completely covered in the zone of the edges 12 and 13 shown. Beginning in this covering position in FIG. 1, the element parts 17 can be folded closed into a stack 18, as is shown in FIG. 2. In this folded-closed state, the element parts 17 in the stack 18 are stacked one above the other, extending approximately parallel to one another, as also seen in FIG. 2. All of the element parts 17 are the same width.

With regard to its possible fanning out (FIG. 1) and to any other design aspect and peripheral contour of it that results in the fanned-out state of the element parts 17, the covering element 16 is adapted to the respective course of all of the edges of the opening 11 in such a way that this opening 11 is entirely covered, including in the zone of the edges.

In the exemplary embodiment shown, the at least one covering element 16 is formed of a thin-walled element, such as a plastic part and in particular a plastic film, which represents a one-piece whole. This element, and in particular this plastic film, is permanently pleated to form the individual element parts 17. As a result, the individual element parts 17 are folded in approximately accordionlike or zigzag fashion, forming respective creases 19 extending longitudinally of their long edges, which depending on how fanned out the covering element 16 is are approximately V-shaped; the opening angle of the V varies as the covering element 16 is folded open and closed again, and specifically increases or, in the formation of the folded-closed stack 18, becomes virtually zero. The plastic part, in particular the plastic film, that the covering element 16 is formed from by being pleated can have high reflectivity on at least one side, and for that purpose this plastic film may for instance be coated on that side, for instance with aluminum, gold, or the like. This plastic film may equally well be transparent, at least in one direction, from the uncoated side toward the coated side. The plastic film may be relatively thin. A thin plastic film has the advantage that in the fully folded-closed state shown in FIG. 2, a very low height results for the stack 18, and thus in this state the covering device 10 requires very little space. The thin-walled nature of the plastic part, in particular the plastic film, also leads to low weight and easier manipulation. Because of the permanent pleating of the covering element 16, it is attained that the element parts 17, at least in the fanned-out state in FIG. 1, are essentially rigid in the zone of the creases 19. The pleated covering element 16 looks like a fan, and in the fanned-out state, it represents an essentially stiff structure transversely to the plane in which the fanning out takes place.

In the fanned-out covering position, the covering element 16, even without any additional stabilizing elements, is a rigid two-dimensional structure. The peripheral contour of the covering element 16 is selected such that in the fanned-out covering position in FIG. 1, the opening 11 is essentially fully covered, not only at the edges 12, 13, but also in the zone of the other edges or peripheral parts that are not shown in FIG. 1.

As seen particularly in FIGS. 1 and 2, the element parts 17 are at least essentially brought together in a common zone 21 and are held together there, forming a stacked block 60. The cohesion can be effected by means of a holding-together part 22 which can be of manifold designs, for instance an intrinsically stiff approximately U-shaped clamp made of metal, plastic, or the like. The holding-together part 22 may also be formed of an adhesive tape, an adhesive film, or the like. The element parts 17 can also be joined and held together in this common zone 21, for instance by adhesive bonding, to form the stacked block 60.

The at least one covering element 16 has two peripheral parts 24 and 25, which in the fanned-out state, for instance in FIG. 1, extend at an angle to one another and which in the common zone 21 are brought together at a suitable point in space and in particular are joined together pivotably about a pivot axis 70. The two peripheral parts 24 and 25 are independent elements, which engage associated edges of the covering element 16. In the first exemplary embodiment in FIGS. 1 and 2, relatively thin, solid reinforcing strips 78 and 79 are secured, for instance by adhesive bonding, to both associated edges of the covering element 16. The peripheral parts 24 and 25 are secured to these reinforcing strips 78, 79. In the zone of the edges of the covering element 16 that are oriented toward the peripheral parts 24, 25, it is also possible, dispensing with the peripheral parts 24, 25 and/or the reinforcing strips 78, 79, for peripheral elements 63 and 64 to be formed by parts of the covering element 16 itself. The independent peripheral parts 24 and 25 each have at least respective flat ribs 68 and 69 and these flat ribs 68, 69 engage the peripheral elements 63, 64, which are formed by parts of the covering element 16 itself, or they engage reinforcing strips 78, 79 that are fixed to the covering element 16. At least in the common zone 21 and at the level of the stacked block 60, the peripheral parts 24, 25 have lateral flanks 72, 73, joined to the flat ribs 68, 69, as coverings for the stacked block 60. In a further exemplary embodiment, the peripheral parts 24, 25 are not joined together via a common joint in the zone of the pivot axis 70 but instead each independently engages only the covering element 16 directly. In this way, the covering element 16 acts as a connecting member between the two peripheral parts 24, 25, which requires perfect functioning, particularly when the covering device 10 is manually actuated.

A special feature of the covering device 10 is that the stacked block 60 is embodied as an independently freely movable part. The stacked block 60 is not fixedly attached to the peripheral parts 24, 25. It is pivotable, because of the fan motion of the element parts 17. The stacked block 60, both in the fanned-out open state of the element parts 17 (FIG. 1) and in the folded-closed state (FIG. 2), merges via a compensation zone 65, 66 with the zone of the covering element 16 bordering on the stacked block 60. The compensation zone 65, 66 forms curved courses on both sides, in the fanned-out state of the element parts 17 in FIG. 1. In the zone of the covering element 16 that adjoins the stacked block 60, a pivot axis 67 of the covering element 16 is embodied, and this pivot axis 67 borders on the stacked block 60 or is embodied spaced apart from it. The stacked block 60 is variable in position relative to the pivot axis 70 because of the fan motion of the element parts 17, in such a way that as a result of this positional variation of the stacked block 60, the spacing measured between the free end 71 of the stacked block 60 and the pivot axis 70 is variable. The arrangement in a first embodiment is made such that the stacked block 60, at least in the folded-closed state of the element parts 17 in FIG. 2, protrudes past the respective end 61, 62, toward the stacked block 60, of the two outer peripheral elements 63, 64, formed by parts of the covering element 16, or of peripheral parts 24, 25 fixed thereon. In another embodiment, at least one of the two reinforcing strips 78, 79 and/or at least one of the flat ribs 68, 69 of the peripheral parts 24, 25 extends beyond the end of the stacked block 60. The flat ribs 68, 69, which are joined pivotably about the pivot axis 70, may be sufficient as peripheral parts 24, 25. In the exemplary embodiment shown, the peripheral parts 24, 25 for instance comprise profiles of approximately U-shaped cross section, in which the flat ribs 68, 69 form parts of these peripheral parts 24, 25. The lateral flanks 72, 73 joined to the flat ribs 68, 69 are formed by the two legs of the U. The two peripheral parts 24, 25 may also be embodied as angle sections, for instance.

The flat ribs 68, 69 are not fixedly attached to the stacked block. In a first embodiment, with their end 61, 62 toward the stacked block 60, they reach at most approximately as far as the stacked block 60. The pivot axis 67 of the covering element 16 and the pivot axis 70 of the peripheral parts 24, 25 can at least approximately coincide or extend spaced apart from one another. Both the pivot axis 67 and the pivot axis 70 may extend on the side diametrically opposite the free end 71 of the stacked block 60, as is shown particularly in FIG. 2.

The covering device 10 as described has the special advantage that in the fanned-out covering position and in its property as a closure device for the opening 11, it enables the complete as possible covering of the opening in the zone of the edge 12 and in particular in the zone of the other edge 13 as well, since because of the freely movable stacked block 60 in the fanned-out position, the left peripheral zone, in terms of FIG. 1, of the covering element 16 can extend parallel to the course of the edge 13 there and up as far as that edge, even as far as the common zone 21, so that even in that zone, the complete as possible covering results.

Figure 3:
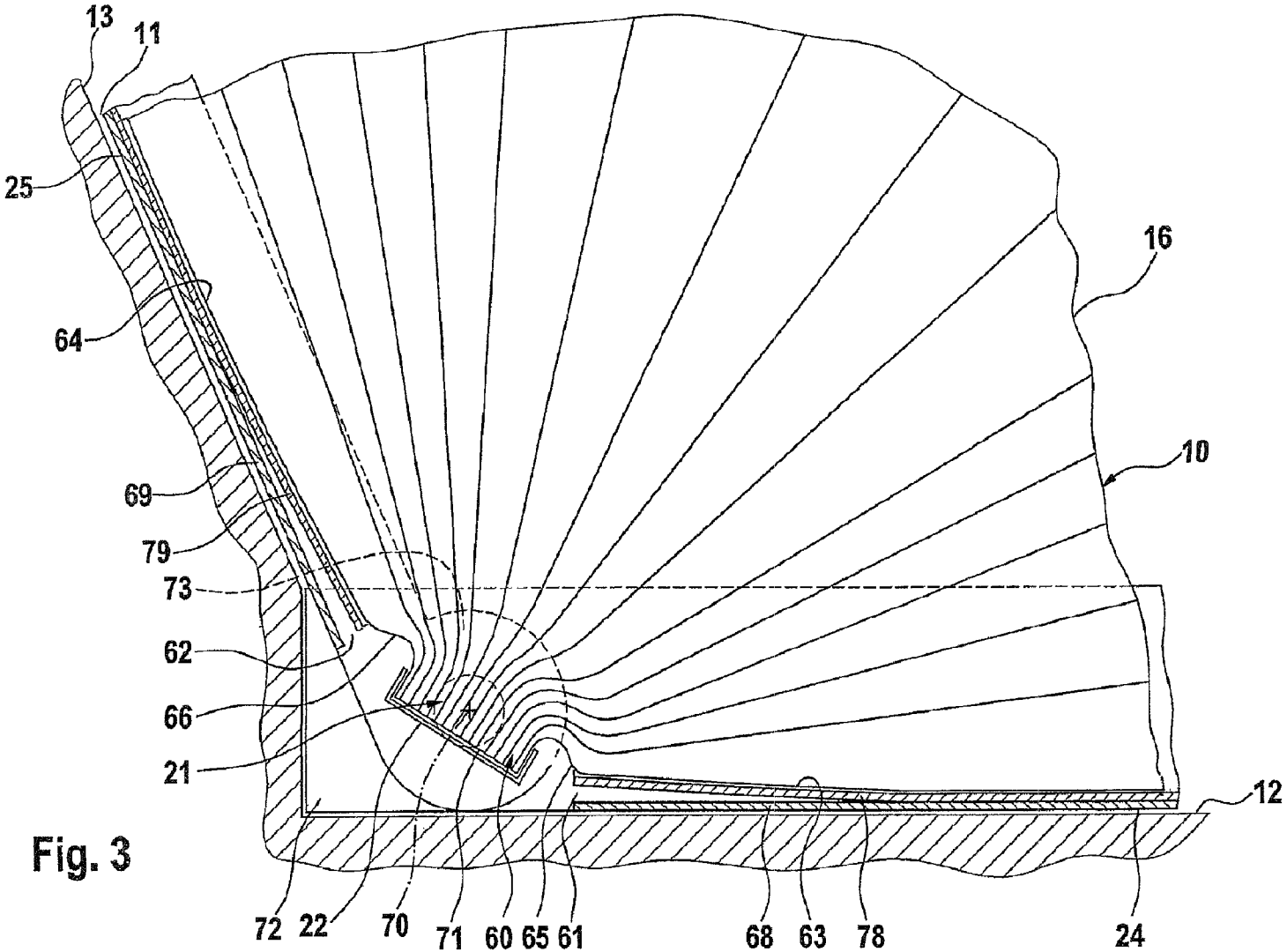
FIG. 3, a schematic side view of a covering device, corresponding approximately to that of FIG. 1, in a second exemplary embodiment in a covering position in which an opening is completely covered.

In the second exemplary embodiment shown in FIG. 3, the same reference numerals are used for those parts that correspond to the first exemplary embodiment, so that to avoid repetition, reference is made to the description of the first exemplary embodiment in FIGS. 1 and 2.

In the second exemplary embodiment, the reinforcing strips 78, 79 which are affixed, for instance glued to the peripheral elements 63, 64, are freely movable relative to the flat ribs 68, 69, engaging them, of the peripheral parts 24, 25, at least over a longitudinal course of the peripheral elements 63, 64 or reinforcing strips 78, 79 that is located close to the stacked block 60. This is illustrated in FIG. 3 by the resultant gap between the reinforcing strips 78, 79 and the flat ribs 68 and 69, respectively. This free movability promotes a behavior of the covering element 16 of effecting the most complete possible peripheral covering of the opening 11 in the fanned-out covering position in FIG. 3. A further advantage of this embodiment of the reinforcing strips 78, 79 is that in an embodiment of the covering device 10 as in FIG. 3, all the longitudinal edges 81 through 84 can be embodied as considerably longer than what is shown in FIG. 3, yet without the lower corner of the stacked block 60 protruding downward past the lower edge of the lateral flank 72. Lengthening the longitudinal edges 81 through 84 makes the coated zone of the element parts 17, by way of which zone the force-transmitting connection between the element parts 17 is made, larger, so that the maximally effective forces of cohesion in the stacked block 60 can be increased considerably as well.

Figure 4:
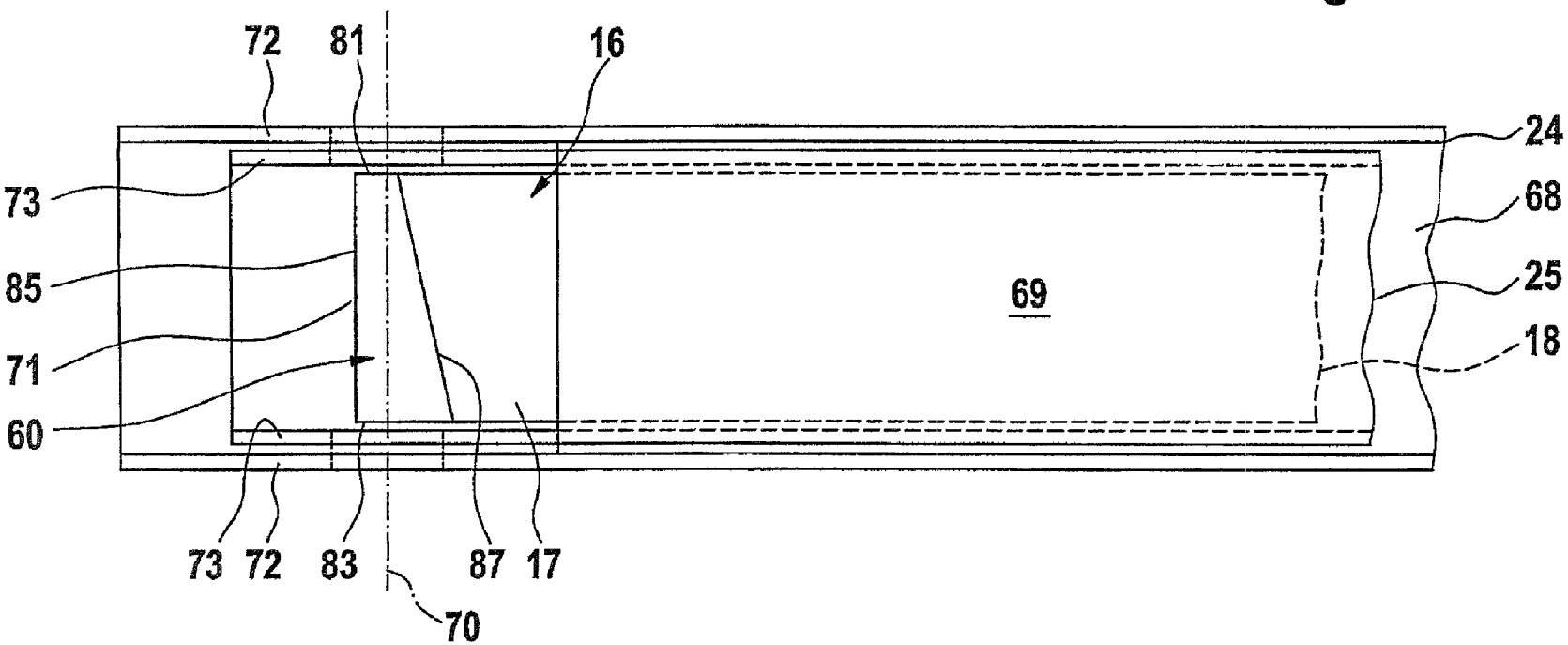
FIG. 4, a schematic top view of a covering device in a third exemplary embodiment, in which the covering device is folded completely closed to form a stack.
Figure 10:
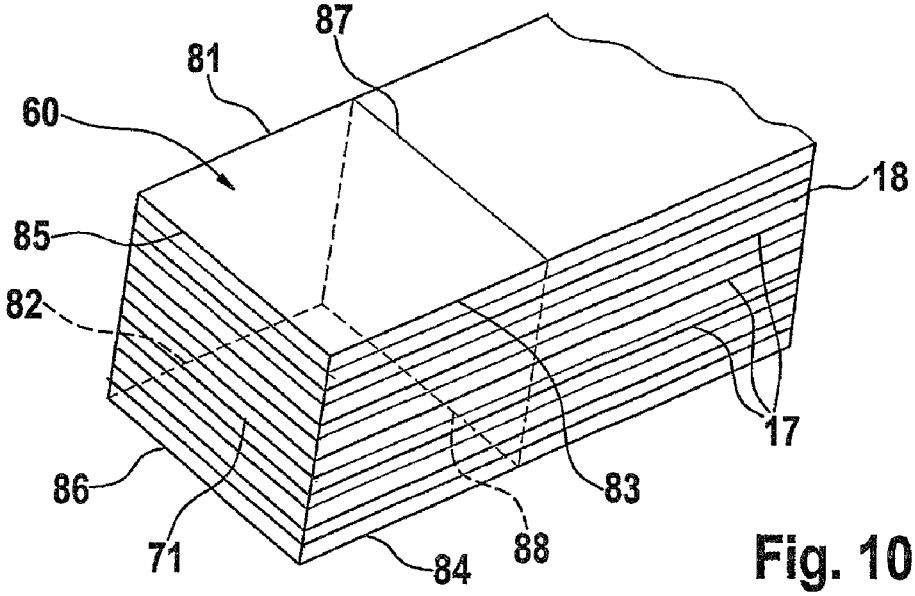
FIG. 10, a schematic perspective view of part of a covering element folded completely closed into a stack.

In the third exemplary embodiment shown in FIG. 4 as well, identical reference numerals are used for the reasons given. It is clear from FIG. 4 that the peripheral parts 24, 25 are each U-shaped profiles, which have legs of the U protruding on both sides of the respective flat rib 68, 69, and per peripheral part 24, 25, lateral flanks 72, 73 joined on both sides to the flat rib 68, 69 are provided. FIG. 4 shows that the flat rib 69 ends spaced apart from the stacked block 60. The same is correspondingly true for the other flat rib 68 of the peripheral part 24. FIG. 10 clearly shows that the stacked block 60 may for instance be rectangular in shape in top view.

A trapezoidal shape is instead possible as well. In all cases, viewed in a top view with the covering element 16 folded closed, the stacked block 60 has a two-dimensional shape, which is formed by upper longitudinal edges 81, 83 on both sides, by an upper, outer transverse edge 85 extending on the free end 71, and by an upper transverse line 87, located on the diametrically opposite side, which extends spaced apart from the upper, outer transverse edge 85. In addition, viewed from below with the covering element 16 folded closed, the stacked block 60 has a two-dimensional shape that is formed by lower longitudinal edges 82, 84 on both sides, by a lower, outer transverse edge 86 extending on the free end 71, and by a lower transverse line 88, located on the diametrically opposite side, which extends spaced apart from the lower, outer transverse edge 86. This is shown especially clearly in the perspective view in FIG. 10.

The design of the stacked block 60 with regard to this three-dimensional contour, for instance of the individual lines or edges mentioned, can have an influence on the behavior as the covering element 16 is fanned out and on the resultant shape. In FIG. 4, for the third exemplary embodiment, a possibility is shown in which the upper transverse line 87 does not extend approximately parallel to the upper, outer transverse edge 85 but instead is oriented obliquely, such that the upper longitudinal edge 81 is shorter than the upper longitudinal edge 83 parallel to it. The stacked block 60 is for instance designed precisely the same way when seen from below. Because of this oblique course of the upper and lower transverse lines 87, 88, when the covering element 16 is fanned out into the covering position, action is exerted on it such that the covering element 16 in the fanned-out covering position is urged in the direction of the upper longitudinal edge 81 and acted upon in such a way that any motion transverse to the surface of the covering element 16 in the direction of the other upper longitudinal edge 83 is counteracted. Hence certain stabilizing forces bring about stabilization of the covering element 16 within the covering plane and counteract any falling out from it in the direction of the upper longitudinal edge 83. Moreover, by means of the described design of the stacked block 60, action can be exerted quite directly on the course of the free peripheral edge of the covering element 16, specifically in such a way that the free peripheral edge and thus also the covering element 16 extend within a precisely defined area in space. This area in space may have various three-dimensionally curved zones. If the covering element 16 is used for instance for covering a vehicle window with a curved upper edge, then the free peripheral edge of the covering element 16 can be adapted exactly to the course of the upper curved window edge. This adaptation is done in such a way that the course of the curved window edge, with regard to its values on the X, Y and Z axes, is replicated exactly by the free peripheral edge of the covering element 16, and thus no gap of any kind is created between the inner edge of the curved window edge and the associated free peripheral edge of the covering element 16.

In general, the invention opens up the possibility, by means of variable design of the individual lines and edges that define the stacked block 60 in FIG. 10, of having an influence on the fanned-out covering element 16.

Hence it may be advantageous that the upper, outer transverse edge 85 and/or the lower, outer transverse edge 86 has a rectilinear course or a curvilinear course or a course that is composed of one rectilinear and one curvilinear portion.

Figure 6:
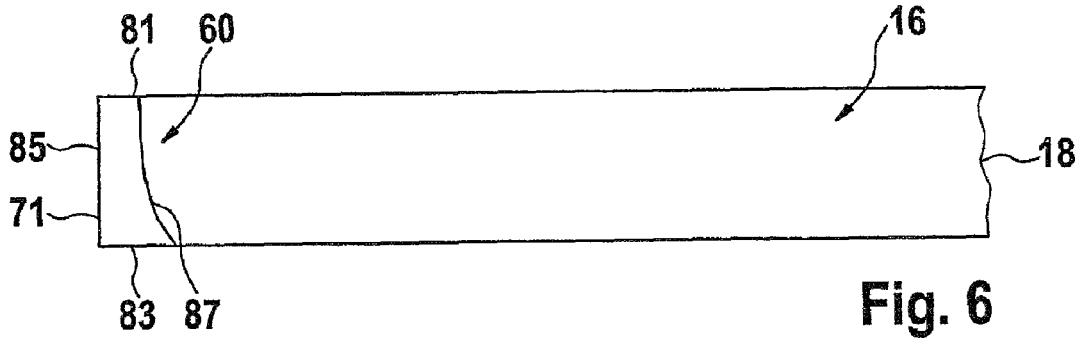
Figure 7:
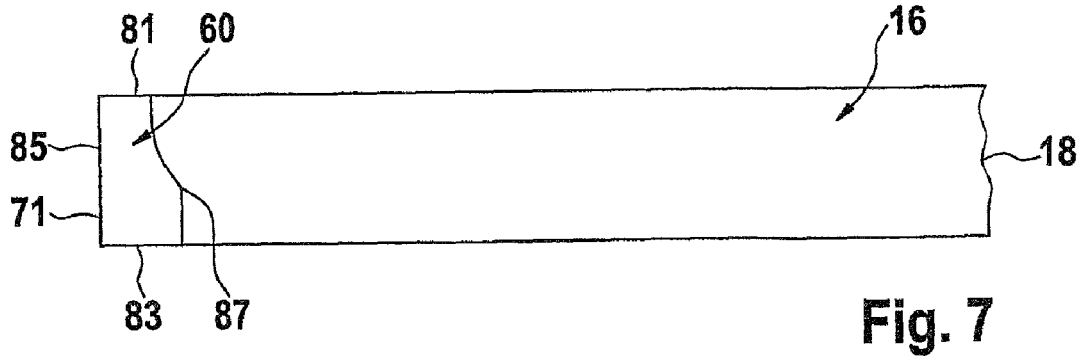

It may also be advantageous if the upper transverse line 87 and/or the lower transverse line 88 has a rectilinear course or a curvilinear course approximately in accordance with FIG. 6, or a course of the kind that is composed of one rectilinear and one curvilinear portion, as shown in FIG. 7.

Figure 5:
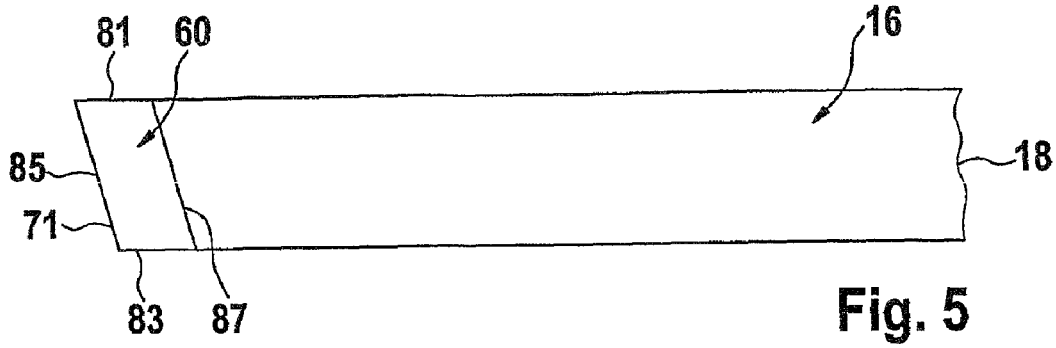
FIGS. 5, 6 and 7, each, a schematic top view of a covering element, folded completely closed into a stack, in a fourth, fifth, and sixth exemplary embodiment, respectively.
Figure 8:
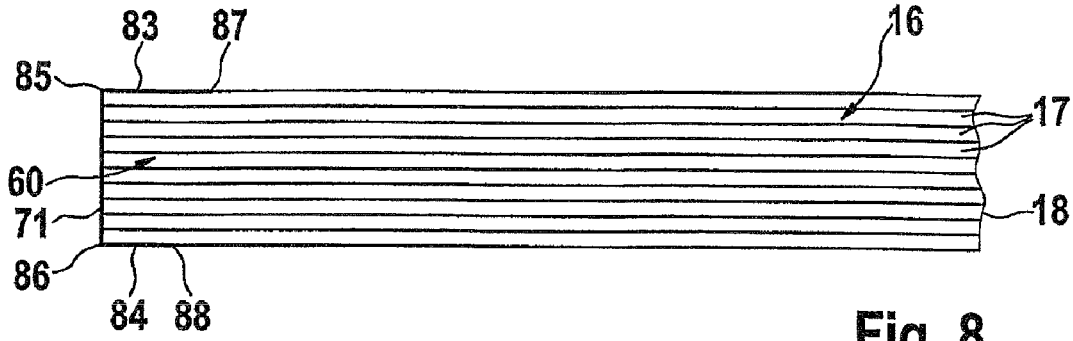
FIGS. 8 and 9, each, a schematic side view of a covering element folded completely closed into a stack, in a seventh and eighth exemplary embodiment, respectively.
Figure 9:
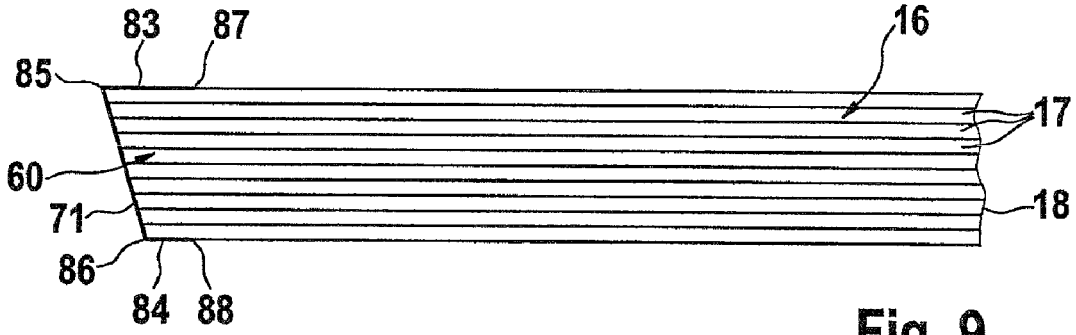

The two outer transverse edges 85, 86 may extend parallel to one another, as can be the case for instance in the examples in FIGS. 5 through 7 and/or in FIGS. 8 and 9 and as is shown for instance in FIG. 10. Instead or in addition, the two transverse lines 87, 88 may also extend parallel to one another, as is shown for instance in FIG. 10 and as can also be the case in one of the FIGS. 5 through 9.

The upper, outer transverse edge 85 and the upper transverse line 87 and/or the lower, outer transverse edge 86 and the lower transverse line 88 may also extend parallel to one another. It may also be advantageous if the upper, outer transverse edge 85 and/or the upper transverse line 87 extend at an angle of approximately 90° to an upper longitudinal edge 81, 83. Instead, the upper, outer transverse edge 85 and/or the upper transverse line 87 may extend at an angle other than 90° to one of the upper longitudinal edges 81, 83. It may furthermore be advantageous if at least one of the longitudinal edges 81 through 84 of the stacked block 60 is shorter than another longitudinal edge. This is the case for instance in the exemplary embodiment in FIGS. 6 and 7. In the exemplary embodiment in FIG. 8, the longitudinal edges 82, 84 on both sides may be of equal length to each other, but shorter than the two upper longitudinal edges 81, 83. The ratios for the stacked block 60 in FIG. 9 may also be selected, in which in addition the free end 71 of the stacked block, considered as a surface, is not oriented perpendicular to the stacked element parts 17, as in FIG. 8, but instead extends obliquely to them. The third exemplary embodiment shown in FIG. 4 shows such a design of the stacked block 60, in which the upper, outer transverse edge 85 and the upper transverse line 87 do not extend parallel to one another; instead, the upper transverse line 87 is oriented obliquely and at an angle other than 90° to the longitudinal edge 81. In the exemplary embodiment in FIG. 5, instead, the upper, outer transverse edge 85 is also oriented correspondingly obliquely and extends parallel to the upper transverse line 87.

All these embodiments of the most various kinds of the stacked block 60 of FIGS. 4 through 10 lead to various advantageous influences on the fanned-out covering element 16.

In other exemplary embodiments not especially shown, it is provided that at least some of the element parts 17 or all of them, on at least one side, either are or are embodied as carriers of one or more identical or nonidentical function units or the like. Of these, at least one function unit may be embodied as a solar cell, as a heating element, or as an information carrier, such as an electronic circuit. Also, at least one function unit may be embodied as an light-emitting medium. Such an light-emitting medium may be embodied as an active medium, which lights up only when a voltage is applied, or as a passive medium, which is activated when struck by radiation, in particular light, in particular by way of reflection or fluorescence. The active medium may for instance be embodied as an OLED structure, which is applied directly to the element parts 17. It is understood that the light-emitting medium may also be formed by a combination of an active light-emitting medium and a passive light-emitting medium. In this way, the manifold further functions and properties can be lent to the covering device 10 by means of integration.

The invention claimed is:

1. A covering device for surfaces or for windows, doors, or similar openings or zones or for surface portions of the aforementioned items, having at least one covering element (16), which has movable element parts (17) joined in zigzag fashion and capable of being fanned out and closed like a fan, which can be fanned out into an approximately two-dimensional shape of the covering element (16) and closed to make a stack (18), and the at least one covering element (16) has two peripheral parts, which either are independent peripheral parts (24, 25) or are formed by parts of the covering element (16) and which in the fanned-out state extend at an angle to one another and which in a common zone (21) are at least substantially brought together, and the element parts (17) in the common zone (21) are held together forming approximately a stacked block (60), the stacked block (60) is embodied as an independently freely movable part, and because of the fan motion of the element parts (17), the stacked block (60) is positionally variable relative to a pivot axis (70) in such a way that as a result of this positional variation of the stacked block (60), the spacing measured between a free end (71) of the stacked block (60) and the pivot axis (70) is variable, wherein flat ribs (68, 69) engage the peripheral parts (63, 64) of the covering element (16) in the form of independent peripheral parts (24, 25) or reinforcing strips (78,79), and the flat ribs (68, 69) are not fixedly attached to the stacked block (60), and the peripheral elements (63, 64) formed by parts of the covering element (16), or by reinforcing strips (78, 79) fixed to them, are freely movable relative to the flat ribs (68, 69), engaging them, of the independent peripheral parts (24, 25), at least over a longitudinal course, close to the stacked block (60), of the peripheral elements (63, 64) or reinforcing strips (78, 79), respectively.

2. The covering device as defined by claim 1, wherein the stacked block (60) is not fixedly attached to both peripheral parts.

3. The covering device as defined by claim 1, wherein the stacked block (60), in both the fanned-out and the closed state of the element parts (17), merges, via an adjoining compensation zone (65, 66) extending from the stacked zone (60) to the flat ribs (68, 69).

4. The covering device as defined by claim 3, wherein the compensation zone (65, 66), in the fanned-out state of the element parts (17), forms curved courses on both sides extending from the stacked zone (66) to the flat ribs (68, 69).

5. The covering device as defined by claim 1, wherein the stacked block (60) is pivotable because of the fan motion of the element parts (17).

6. The covering device as defined by claim 1, wherein a pivot axis (67) of the covering element (16) is embodied in the zone of the covering element (16) that adjoins the stacked block (60), and this pivot axis (67) borders on the stacked block (60) or is embodied spaced apart from it.

7. The covering device as defined by claim 1, wherein the stacked block (60), at least in the closed state of the element parts (17), protrudes past the respective ends (61, 62) facing the element parts of the two outer peripheral elements (63, 64), formed by parts of the covering element (16), or of peripheral parts (24, 25) fixed thereon.

8. The covering device as defined by claim 1, wherein the flat ribs (68, 69), with their ends (61, 62) facing toward the stacked block (60), reach at most approximately as far as the stacked block (60).

9. The covering device as defined by claim 1, wherein the pivot axis (67) of the covering element (16) and the pivot axis (70) of the peripheral parts (24, 25) at least approximately coincide or extend spaced apart from one another.

10. The covering device as defined by claim 9, wherein the pivot axis (67) of the covering element (16) and the pivot axis (70) of the peripheral parts (24, 25) extend on the side of the stacked block (60) diametrically opposite the free end (71) of the stacked block.

11. The covering device as defined by claim 1, wherein the peripheral parts (24, 25), at least in the common zone (21) and at the level of the stacked block (60), have lateral flanks (72, 73), as coverings for the stacked block (60), which are joined to the flat ribs (68, 69).

12. The covering device as defined by claim 1, wherein the cohesion of the element parts (17) in the common zone (21) is effected by means of a holding-together part (22).

13. The covering device as defined in claim 1, wherein the stacked block (60), viewed in a top view with the covering element (16) closed, has a two-dimensional shape which is formed by upper longitudinal edges (81, 83) on both sides, by an upper, outer transverse edge (85) extending on the free end (71), and by an upper transverse line (87), located on the diametrically opposite side and extending in a distance from the upper, outer transverse edge (85).

14. The covering device as defined in claim 13, wherein the stacked block (60), viewed in a view from below with the covering element (16) closed, has a two-dimensional shape which is formed by lower longitudinal edges (82, 84) on both sides, by a lower, outer transverse edge (86) extending on the free end (71), and by a lower transverse line (88), located on the diametrically opposite side and extending in a distance from the lower, outer transverse edge (86).

15. The covering device as defined by claim 14, wherein the upper, outer transverse edge (85) and/or the lower, outer transverse edge (86) has a rectilinear course or a curvilinear course or a course composed of one rectilinear and one curvilinear portion.

16. The covering device as defined by claim 14, wherein the upper transverse line (87) and/or the lower transverse line (88) has a rectilinear course or a curvilinear course or a course composed of one rectilinear and one curvilinear portion.

17. The covering device as defined by claim 14, wherein the two outer transverse edges (85, 86) extend parallel to one another and/or the two transverse lines (87, 88) extend parallel to one another.

18. The covering device as defined by claim 14, wherein the upper, outer transverse edge (85) and the upper transverse line (87) and/or the lower, outer transverse edge (86) and the lower transverse line (88) extend parallel to one another.

19. The covering device as defined by claim 14, wherein the upper, outer transverse edge (85) and/or the upper transverse line (87) extends at an angle of approximately 90° to an upper longitudinal edge (81, 83).

20. The covering device as defined by claim 14, wherein the upper, outer transverse edge (85) and/or the upper transverse line (87) extends at an angle of other than 90° to an upper longitudinal edge (81, 83).

21. The covering device as defined by claim 14, wherein at least one of the longitudinal edges (81 through 84) of the stacked block (60) is shorter than another longitudinal edge.

22. The covering device in particular as defined by claim 1, wherein at least some, or all, of the element parts (17) on at least one side are carriers of one or more identical or nonidentical function units or the like, or are embodied as such.

* * * * *